United States Patent [19]

Ott

[11] 3,941,250

[45] Mar. 2, 1976

[54] FOLDABLE SUPPORT

[76] Inventor: Walter Ott, 3886 Pearl St. Road, Batavia, N.Y. 14020

[22] Filed: Mar. 17, 1975

[21] Appl. No.: 559,335

[52] U.S. Cl. ..... 211/1.3; 211/100; 211/171; 248/294; 248/308

[51] Int. Cl.[2] ..... A47B 53/00

[58] Field of Search ..... 248/308, 218, 290, 291, 248/294; 211/1.3, 100, 96, 168, 170–172

[56] References Cited

UNITED STATES PATENTS

| | | | |
|---|---|---|---|
| 1,705,203 | 3/1929 | Patterson | 211/1.3 |
| 2,500,881 | 3/1950 | Stader | 211/100 |
| 2,626,714 | 1/1953 | Rover | 211/100 |
| 2,672,241 | 3/1954 | Cohen et al. | 211/100 |

FOREIGN PATENTS OR APPLICATIONS

| | | | |
|---|---|---|---|
| 1,456,864 | 9/1966 | France | 211/1.3 |
| 299,698 | 8/1932 | Italy | 248/308 |

*Primary Examiner*—Roy D. Frazier
*Assistant Examiner*—Terrell P. Lewis
*Attorney, Agent, or Firm*—Sommer & Sommer

[57] ABSTRACT

A foldable support, adapted to be mounted on a vertical wall, includes an elongated vertical housing, and an arm having an end portion pivotally mounted on a lower portion of the housing and adapted to be selectively moved between a raised position at which the arm is concealed within the housing, and a lowered position at which the arm projects horizontally outwardly therefrom. The housing has a channel-shaped transverse cross-section formed by a pair of transversely-spaced vertical flanges separated by an intermediate vertical web. The pivoted end portion of the arm has a U-shaped cross-section provided with a pair of trunnions which are journalled in a pair of bearing openings provided in the housing. When the arm is moved to the lowered position, an object, such as a clothes hanger, may be hung therefrom.

3 Claims, 5 Drawing Figures

FOLDABLE SUPPORT

BACKGROUND OF THE INVENTION

1. Field of the Invention

The present invention relates generally to the field of foldable supports, and more particularly to a unique foldable support adapted to be mounted on a vertical door or wall in a home, office or trailer and from which a clothes hanger may be hung.

2. Description of the Prior Art

Many motels and homes are commonly provided with conventional closets having an elongated horizontal cylindrical bar or rod upon which a clothes hanger may be hung.

In some instances, it may also be convenient to provide a hanger support on a wall, door, or other suitable vertical member. Obviously, an outwardly extending arm will provide an acceptable support, but such a projecting arm may also interfere with normal usage of and traffic patterns in the room. This disadvantage of an outwardly-projecting arm is particularly acute in the case of door mounting where such arm may interfere with the degree of door movement, or in house trailers where space is at a premium.

SUMMARY OF THE INVENTION

The present invention provides an improved foldable support which is particularly adapted to be mounted on a vertical planar door or wall in a house, office, trailer, or the like, and upon which an object, such as a garment or clothes hanger, may be hung.

The inventive foldable support broadly includes an elongated vertical housing having a channel-shaped transverse cross-section formed by a pair of transversely spaced vertical flanges separated by an intermediate transversely extending vertical web, the flanges and web defining an elongated recess therebetween; and an arm having one end portion pivotally mounted on a lower portion of the housing and adapted to be selectively moved between a raised position, at which the arm is received and partially concealed within the housing recess, and a lowered position at which the arm projects horizontally outwardly from the housing. The pivoted arm end portion has at least one surface arranged to engage a portion of the housing web, when the arm is in the lowered position, to support the weight of an object hung on the outwardly-extending arm.

The arm may include another portion having an inverted substantially T-shaped transverse cross-section and provided with a plurality of longitudinally spaced notches along its upper surface to receive the object.

The pivoted arm end portion may be substantially U-shaped, and may further include a pair of trunnions which are adapted to be received in a complementary pair of bearing-type openings provided in the housing. In the preferred embodiment, the end faces of this U-shaped portion constitute the surfaces which engage the web when the arm is in the lowered position.

If desired, the arm and housing flanges may be provided with complementary longitudinal tapers of from 2°–5° with the vertical so that when the arm is moved from its lowered horizontal position to its raised position, the arm will be moved through an arc of from 92°–95°, this raised position being over-center with respect to the vertical.

Accordingly, one general object of the present invention is to provide an improved foldable support having a pivoted arm adapted to be moved between an inoperative raised position and an operative lowered horizontal position, and upon which a suitable object, such as a clothes hanger or the like, may be hung.

Another object is to provide an improved foldable clothes hanger support which is particularly suited for mounting on a vertical surface of a wall or door in a home, office, or trailer.

Another object is to provide an improved foldable clothes hanger support which may be assembled from two integrally formed parts.

Still another object is to provide an improved foldable support which may be inexpensively manufactured of acetate butyrate styrene, or any other suitable plastic, by a conventional injection molding technique.

These and other objects and advantages will become apparent from the foregoing and ongoing specification, the drawings, and the appended claims.

DESCRIPTION OF THE PREFERRED EMBODIMENTS

Figure 1:
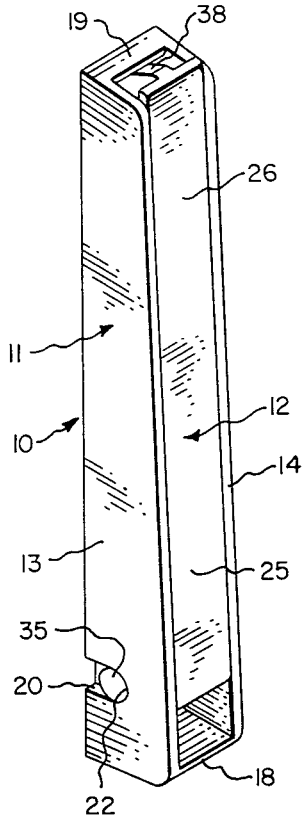
FIG. 1 is a perspective view of the inventive foldable support showing the housing, and the position of the arm in the inoperative raised position.

At the outset, it should be clearly understood that like reference numerals are intended to identify the same elements and/or structure consistently throughout the several drawing figures, as such elements and/or structure may be further described or explained by the entire written specification of which this detailed description is an integral part.

Figure 2:
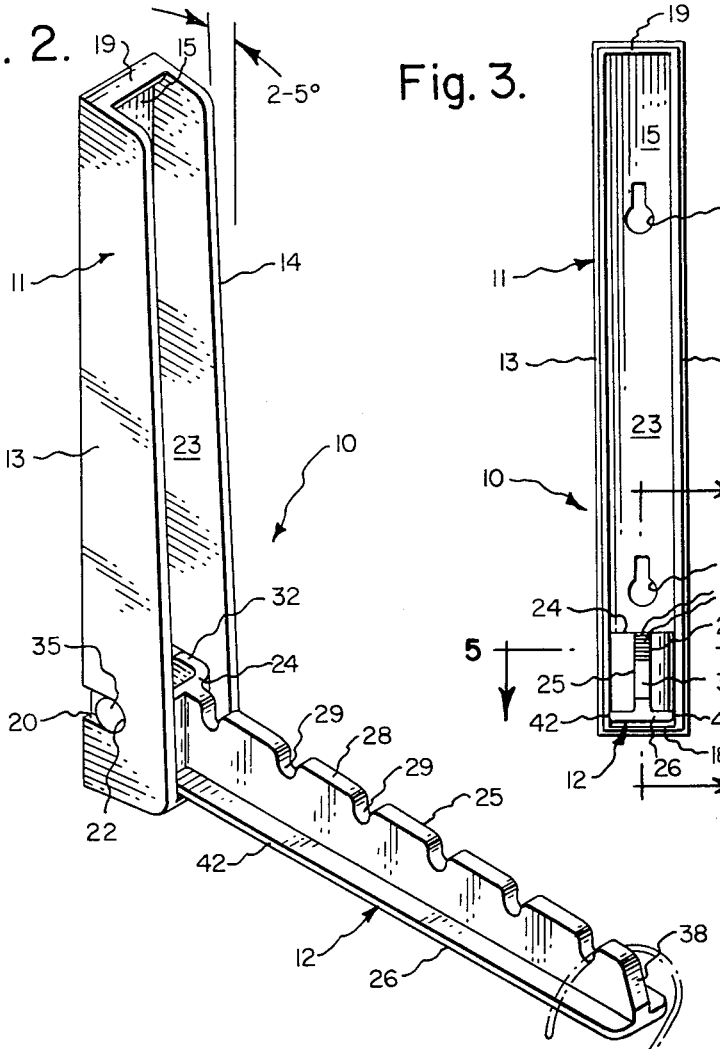
FIG. 2 is a perspective view of the foldable support with the arm moved downwardly to the operative lowered position, this view also showing an object hanging from one of the notches of the horizontally extending arm and further showing the tapered housing flanges.

Referring initially to FIGS. 1 and 2, the present invention provides a foldable support, generally indicated at 10, which is adapted to be mounted on a vertical wall (not shown), such as a door or wall in a trailer, office or house. The inventive foldable support 10 broadly includes an elongated vertical housing, generally indicated at 11, and an elongated arm, generally indicated at 12, pivotally mounted on the housing 11 and adapted to be selectively moved between an inoperative raised position (FIG. 1) and an operative lowered position (FIG. 2) for a purpose hereinafter explained.

Figure 3:
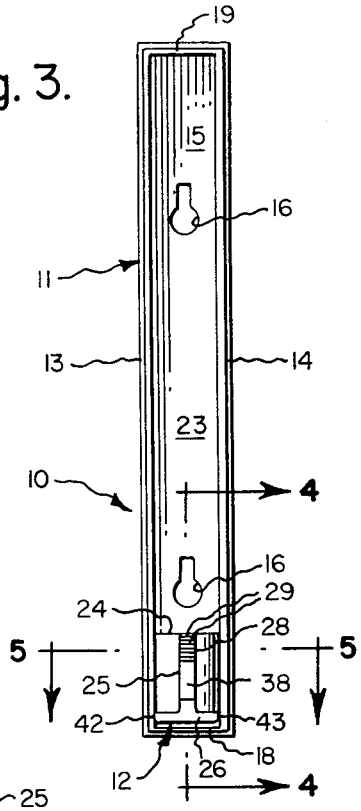
FIG. 3 is a front elevational view of the foldable support illustrated in FIG. 2, this view taken longitudinally along the lowered arm to show the inverted substantially T-shaped cross-section thereof, and further showing the vertically spaced inverted keyhole recesses provided through the housing web.

As best shown in FIGS. 1–3, the vertical housing 11 of the presently preferred embodiment has a generally channel-shaped transverse cross-section (FIG. 5) formed by a pair of left and right horizontally spaced longitudinally extending vertical flanges 13, 14, respectively, separated by an intermediate transversely extending vertical web 15 which, as best shown in FIG. 3, may be suitably provided with a pair of vertically spaced inverted keyhole slots 16 therethrough. In the well known manner, a suitable fastener, such as a headed screw or bolt, may be passed through each keyhole slot 16 and suitably embedded in the wall or door to hold the foldable support housing 11 thereto.

The forward edges of left and right housing flanges 13, 14 are severally shown as being longitudinally or vertically tapered from the deeper horizontal bottom 18 of the housing to the more narrow horizontal top 19 thereof at an acute included angle with the vertical of from 2°–5°, as indicated in FIG. 2.

Figure 5:
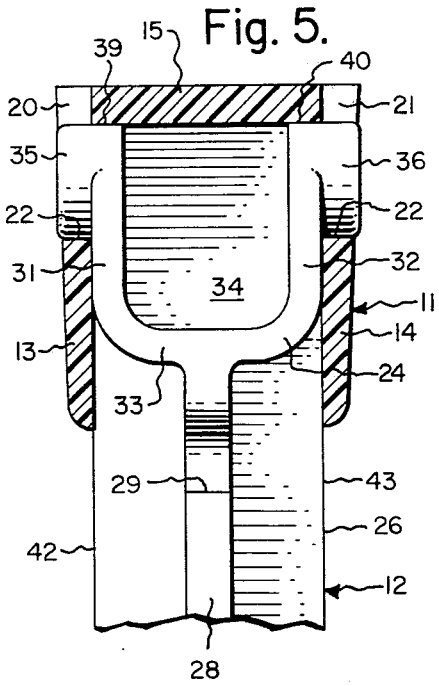
FIG. 5 is an enlarged fragmentary transverse horizontal sectional view thereof, taken generally on line 5—5 of FIG. 3, showing the arm left end portion in top plan, and further showing the arm trunnions received and journalled in the housing bearing-like openings.

Moreover, the housing 11 is shown further provided with a pair of left and right openings 20 and 21, respectively, which function as bearings for a purpose hereinafter explained. As best shown in FIGS. 2 and 5, each of these bearing openings 20, 21 extends forwardly into flanges 13, 14 from a lower portion of web 15 and has a semi-circular forward portion 22.

In this manner, the left and right housing flanges 13, 14 define with the intermediate web 15, a forwardly opening vertically elongated rectangular trough-like recess, indicated at 23 in FIG. 2, this trough being relatively deep in the vicinity of housing bottom 18 and relatively shallow in the vicinity of housing top 19. As shown, the various parts of the presently preferred embodiment of housing 11 may be integrally formed of acetate butyrate styrene, styrene, or any other suitable plastic, by a well known injection molding technique.

Adverting now particularly to FIG. 2, the arm 12 is shown as being an elongated member having a leftward end portion 24 pivotally mounted on a lower portion of housing 11, and another portion 25 continuing rightwardly from left end portion 24 and having an inverted substantially T-shaped cross-section (FIG. 3). In FIGS. 2 and 3, this inverted T-shaped portion 25 is shown as having a lower horizontal base 26, and an upstanding vertical leg 28 provided with a plurality of longitudinally spaced concave notches 29 along its upper surface, in which notches a suitable object, such as a common coat hanger 30, may be hung.

Figure 4:
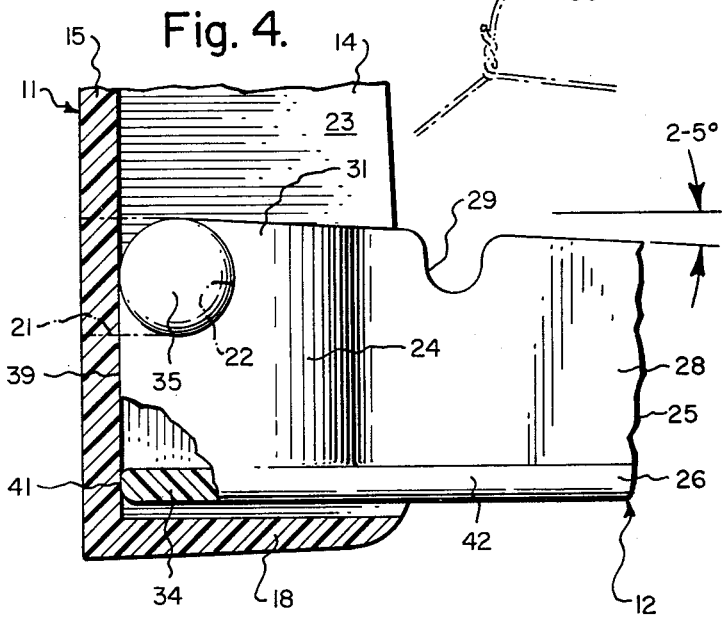
FIG. 4 is an enlarged fragmentary transverse vertical sectional view thereof, taken generally on line 4—4 of FIG. 3, with a portion of the left housing flange broken away to illustrate the pivoted U-shaped left end portion of the arm in side elevation, this view particularly showing the rear surfaces of the arm left end portion engaging only the housing web when the arm is in the lowered position.

Referring now to FIGS. 4 and 5, the leftward arm end portion 24 is depicted as being U-shaped, when viewed in top plan (FIG. 5), having transversely spaced rearwardly extending left and right vertical legs 31, 32 respectively, connected by a transversely extending vertical base 33, and a lower horizontal bottom 34. Legs 31 and 32 are shown further provided with horizontal outwardly extending left and right cylindrical trunnions 35, 36, respectively, which are adapted to be received and journalled in housing bearing openings 20, 21, respectively. As best shown in FIGS. 4 and 5, the cylindrical surface of each of trunnions 35, 36 is tangential to both the end face and the upper surface of its associated leg.

Adverting now to FIGS. 2 and 4, the longitudinally extending upper surface of upstanding leg 28 is also shown provided with a complementary longitudinal taper of about 2°–5° with respect to the horizontal from vertically thicker left end portion 24 to more narrow distal right end portion 38.

Arm 12 may also be integrally formed from acetate butyrate styrene, or any other plastic, by a suitable injection molding technique. While the housing flanges 13, 14 proximate bearing openings 20, 21 are relatively inflexible, due to their proximity to integral housing bottom 18, the portions of arm end portion legs 31, 32 which carry trunnions 35, 36 are relatively flexible and may be squeezed together to facilitate insertion of these trunnions into the housing bearing openings 20, 21 (FIG. 5).

When trunnions 35, 36 have been inserted into housing openings 20, 21, the arm 12 may be pivotally raised to an inoperative position (FIG. 1), or lowered to an operative position (FIG. 2).

It should be noted that when the arm 12 is moved to the raised position (FIG. 1), the arm distal end portion 38 will project slightly above housing top 19 to provide a finger-grip by which an operator may pull and lower this arm.

When the arm 12 is moved to the operative lowered position (FIG. 2), it will be seen that a composite vertical U-shaped end face surface, comprising the transversely extending vertical surfaces 39, 40 of legs 31, 32, respectively, and the lower vertical surface 41 of arm bottom 34, will engage and contact the forwardly-facing vertical planar surface housing web 15 to support the load on the forwardly extending horizontal arm 12. Hence, no part of this load will be directly supported by housing bottom 18, as may be seen in FIG. 4.

Finally, it should be noted that the complementary tapers on the housing and arm permit the arm 12 to be moved from the horizontal position (FIG. 2) to the over-center raised position (FIG. 1). In other words, the arm 12 of the preferred embodiment may be moved through an arc of from 92°–95°. In the raised position (FIG. 1), the arm 12 is frictionally held in recess 23 by the engagement of the lateral edges 42, 43 of arm 12 with the housing flanges 13, 14. This frictional engagement, coupled with the stable over-center position of the arm in the raised position, serves to insure that the arm will remain in the raised position until selectively moved to the lowered position. Finally, it should be noted that when the arm is in this raised position, the bottom surface of arm base 26 will be substantially flush with the forward tapered distal end faces of housing flanges 13, 14, as best shown in FIG. 2.

As used herein, the term "wall" shall be interpreted generally to include a conventional wall, a door, or any other member providing a substantially vertical planar surface.

While the embodiment herein illustrated and described constitutes one specific preferred form of practicing the present invention, it will be readily appreciated by those skilled in this art that various changes and modifications may be made without departing from the true spirit of the invention, which is defined generically by the following claims.

What is claimed is:

1. A foldable support, comprising:

an elongated vertical housing adapted to be mounted on a vertical wall and having a channel-shaped transverse cross-section formed by a pair of transversely spaced vertical flanges separated by an intermediate vertical web having a forwardly facing planar surface, said flanges and web defining an elongated recess therebetween, each of said flanges being vertically tapered such that its horizontal depth decreases with height above the bottom of said housing, each of said flanges being provided with a transversely extending through opening at a lower portion thereof; and an arm having one end portion pivotally mounted on said housing and having another portion continuing outwardly therefrom to the distal end of said arm, said arm being adapted to be selectively moved between a raised position at which said arm is received in said recess, and a lowered position at which said arm projects horizontally outwardly from said housing, said arm one end portion having a substantially U-shaped transverse cross-section terminating in a planar end face surface and having a trunnion extending transversely outwardly from each parallel leg of said one end portion, each of said trunnions having a cylindrical surface tangential to both the end face and the upper surface of its associated leg, said arm being complementarily tapered with said housing flanges to enable said arm to be moved through an arc greater than ninety degrees, whereby, when said arm is in said lowered position, the entire end face surface of said arm one end portion engages said housing web surface for distributing the force exerted by said housing on said arm end face to resist the moment of an object hanging from said arm other portion.

2. A foldable support as set forth in claim 1 wherein said arm other portion has an inverted substantially T-shaped transverse cross-section.

3. A foldable support as set forth in claim 1 wherein the arc through which said arm may be moved is from 92° to 95°.

* * * * *